US010068723B2

(12) United States Patent
Oyamada et al.

(10) Patent No.: US 10,068,723 B2
(45) Date of Patent: Sep. 4, 2018

(54) SWITCH AND METHOD FOR MANUFACTURING SAME

(71) Applicants: CITIZEN ELECTRONICS CO., LTD., Yamanashi (JP); CITIZEN WATCH CO., LTD., Tokyo (JP)

(72) Inventors: Tetsu Oyamada, Yamanashi (JP); Tsuyoshi Miura, Yamanashi (JP); Mitsunori Miura, Yamanashi (JP)

(73) Assignees: CITIZEN ELECTRONICS CO., LTD., Yamanashi (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 15/519,352

(22) PCT Filed: Aug. 20, 2015

(86) PCT No.: PCT/JP2015/073389
§ 371 (c)(1),
(2) Date: Apr. 14, 2017

(87) PCT Pub. No.: WO2016/059872
PCT Pub. Date: Apr. 21, 2016

(65) Prior Publication Data

US 2017/0229258 A1 Aug. 10, 2017

(30) Foreign Application Priority Data

Oct. 15, 2014 (JP) ..... 2014-211039

(51) Int. Cl.
*H01H 13/04* (2006.01)
*H01H 11/00* (2006.01)

(52) U.S. Cl.
CPC ..... *H01H 13/04* (2013.01); *H01H 11/00* (2013.01); *H01H 11/0056* (2013.01); *H01H 2011/0081* (2013.01); *H01H 2215/006* (2013.01)

(58) Field of Classification Search
CPC ..... H01H 11/0056; H01H 2215/004; H01H 2011/0081
See application file for complete search history.

(56) References Cited

U.S. PATENT DOCUMENTS 4,843,197 A * 6/1989 Kojima ..... H01H 11/0056 200/302.2
2005/0272309 A1 12/2005 Murayama et al.
2011/0089004 A1 4/2011 Yanai et al.

FOREIGN PATENT DOCUMENTS

CN 1453807 A 11/2003
CN 1648816 A 8/2005
(Continued)

OTHER PUBLICATIONS

International Search Report for PCT/JP2015/073389, dated Nov. 10, 2015.
(Continued)

*Primary Examiner* — Felix O Figueroa

(57) ABSTRACT

A switch that more reliably prevents solvent permeation from the outside, and a manufacturing method thereof are provided. The switch includes a first molded resin molded integrally with a plurality of fixed contacts by insert molding, a movable member disposed above the first molded resin to bring the plurality of fixed contacts into and out of contact with each other, and a second molded resin molded so as to close a through hole of the first molded resin formed by a pin supporting the plurality of fixed contacts at a time of the insert molding.

4 Claims, 5 Drawing Sheets

(56) References Cited

FOREIGN PATENT DOCUMENTS

| | | | |
|---|---|---|---|
| CN | 102044365 | A | 5/2011 |
| JP | S59-051422 | A | 3/1984 |
| JP | S60-170118 | A | 9/1985 |
| JP | S61-022517 | A | 1/1986 |
| JP | S63-069115 | A | 3/1988 |
| JP | H06-187870 | A | 7/1994 |
| JP | 2011-044608 | A | 3/2011 |
| JP | 2013-191482 | A | 9/2013 |
| JP | 2014-025770 | A | 2/2014 |

OTHER PUBLICATIONS

Written Opinion of the International Searching Authority for PCT/JP2015/073389, dated Nov. 10, 2015.
State Intellectual Property Office of the People's Republic of China, First Office Action with Search Report for Chinese Patent Application No. 201580056013.3, Jul. 2, 2018.
European Patent Office, Extended European Search Report for EP Patent Application No. 158514265, May 2, 2018.

* cited by examiner

SWITCH AND METHOD FOR MANUFACTURING SAME

TECHNICAL FIELD

The present invention relates to a switch and a manufacturing method thereof.

BACKGROUND ART

FIG. 9 is a schematic longitudinal sectional view of a push switch 100 widely used for electronic apparatuses, such as mobile phones and audio devices. The push switch 100 includes a central contact 112, an outer contact 114, a case 120, a tactile spring 160, a pressing member 170, and a protection sheet 180. The central contact 112 and the outer contact 114 are made of a metal plate and fixed in a state of being exposed on an inner surface of the case 120. The case 120 is formed by resin molding, and has a concave portion 125 for housing the tactile spring 160 on the inside. The tactile spring 160 is a convex dome-shaped thin metal plate, and is disposed in the concave portion 125 so that the edge of the tactile spring 160 contacts the outer contact 114. The pressing member 170 is disposed between the tactile spring 160 and the protection sheet 180, and transmits an operation load applied to the push switch 100 to the tactile spring 160. The protection sheet 180 is made of a flexible insulating resin sheet, and its edge portion is adhered to the upper surface edge of the case 120 to enclose the tactile spring 160 and the pressing member 170 in the concave portion 125.

When the push switch 100 is pressed from above the protection sheet 180, the dome shape of the tactile spring 160 is inverted by the operation load for the switch. Accordingly, the central contact 112 and the outer contact 114 are electrically connected and the switch is turned on. Further, when the operation load is removed, the dome shape of the tactile spring 160 is restored. Then, the central contact 112 and the outer contact 114 are not electrically connected to each other, and the switch is turned off.

At the time of manufacturing the push switch 100, the case 120 is integrally molded with the central contact 112 and the outer contact 114 by insert molding as described in, for example, Patent Literature 1. After that, the tactile spring 160, the pressing member 170 and the protection sheet 180 are attached. In the insert molding, metal plates (lead frame), which serve as the central contact 112 and the outer contact 114, are supported from below by pins 210 projecting upward from a mold 200 matching the shape of the case 120, and after the metal plates are inserted and fixed between the pins 210 and upper side pins (not depicted), resin injected into the mold 200. In the case 120 molded integrally with the metal plates in this manner, portions (ejector pin marks) corresponding to the pins become through holes 121 from which the metal plates are exposed.

CITATION LIST

Patent Literature

Patent Literature 1: Japanese Unexamined Patent Publication (Kokai) No. 2013-191482

SUMMARY OF INVENTION

Technical Problem

When the through holes 121 are formed in the case 120, solvent 300 such as flux used in mounting by reflow soldering performed after the insert molding or cleaning liquid used for removing the flux, as depicted in FIG. 10, may enter the interface between the metal plates and the molded resin from the through holes 121. Then, for example, since the flux is an insulator, the portion to which the flux adheres does not conduct and a contact failure may occur. In addition, when flux precipitates on the surface of pattern, corrosion may occur.

In order to prevent such permeation of the solvent, it is conceivable to cover the bottom surface of the case 120 with an adhesive insulating sheet, as described in, for example, Patent Literature 1. However, in this case, since the molded resin and the insulating sheet are fixed with the adhesive, the resistance to the solvent is weak and the possibility that the solvent permeates into the interface between the metal plates and the molded resin remains. In the case of covering with a sheet, air in the through holes 121 expands when mounting by reflow soldering is performed, and the insulating sheet swells. Thus, flatness of a product is impaired and mounting defects may be caused.

It is therefore an object of the present invention to provide a switch that more reliably prevents solvent permeation from the outside in comparison with a switch without the features of the disclosed invention, and a manufacturing method thereof.

Provided is a switch including a first molded resin molded integrally with a plurality of fixed contacts by insert molding, a movable member disposed above the first molded resin to bring the plurality of fixed contacts into and out of contact with each other, and a second molded resin molded so as to close a through hole of the first molded resin formed by a pin supporting the plurality of fixed contacts at a time of the insert molding.

Preferably, the second molded resin closes the through hole from below the first molded resin and covers a side surface of the first molded resin, so that the second molded resin in cooperation with the first molded resin forms a case that houses the movable member therein.

Preferably, there is no boundary line between the first molded resin and the second molded resin on a side surface of the case.

Further, provided a method of manufacturing a switch including the steps of molding a first molded resin integrally with a plurality of fixed contacts by insert molding, disposing a movable member for bringing the plurality of fixed contacts into and out of contact with each other above the first molded resin, and molding a second molded resin so as to close a through hole of the first molded resin formed by a pin supporting the plurality of fixed contacts at a time of the insert molding.

According to the above switch and manufacturing method thereof, it is possible to more reliably prevent solvent permeation from the outside in comparison with a switch without the features of the disclosed invention.

DESCRIPTION OF EMBODIMENTS

Hereinafter, with reference to the accompanying drawings, a switch and a manufacturing method thereof will be explained in detail. However, it should be noted that the present invention is not limited to the drawings or the embodiments described below.

Figure 1:
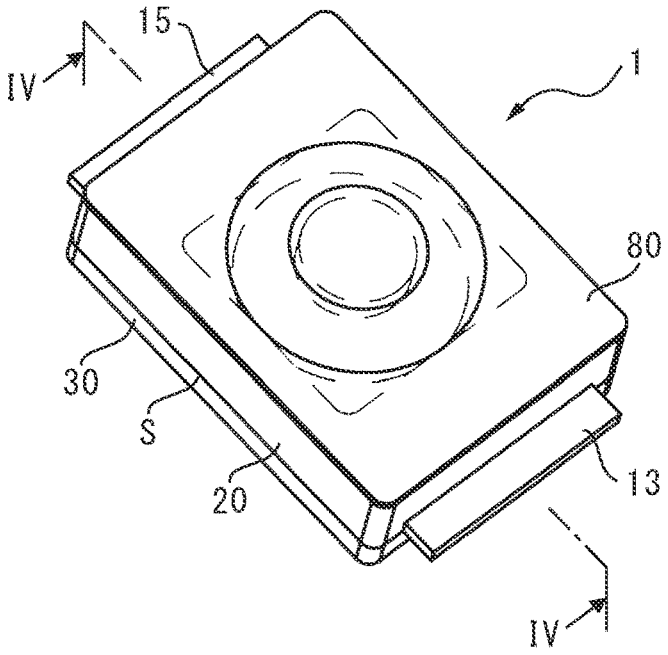
FIG. 1 is a top perspective view of a push switch 1.

FIGS. 1 to 4 are a top perspective view, a bottom perspective view, an exploded perspective view and a sectional view taken along the line IV-IV in FIG. 1, respectively, of a push switch 1. The push switch 1 includes a lead frame 10, a first molded resin 20, a second molded resin 30, a tactile spring 60, a pressing member 70, and a protection sheet 80, as main components. The push switch 1 is a tact switch having a protruding portion with the pressing member 70 at an operation portion, and has a size of, for example, 3 mm×2 mm in plane and 1 mm in height.

Figure 2:
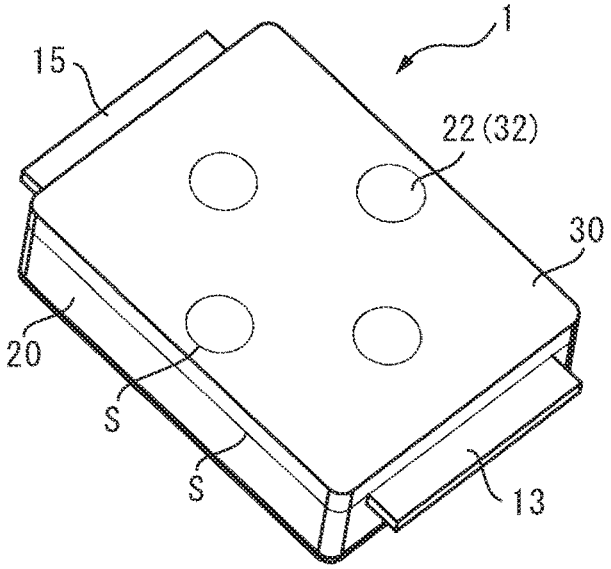
FIG. 2 is a bottom perspective view of the push switch 1.
Figure 3:
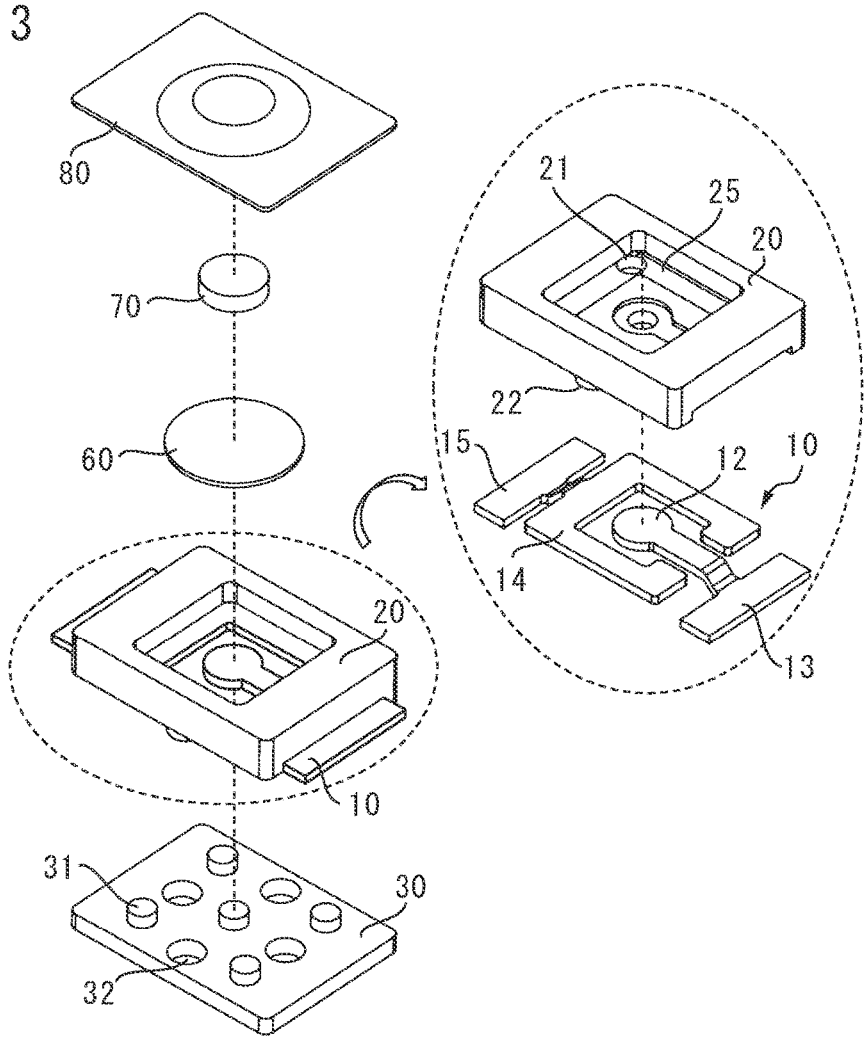
FIG. 3 is an exploded perspective view of the push switch 1.

As depicted in FIG. 3, the lead frame 10 is composed of a metal plate including portions corresponding to a central contact 12 and an electrode 13, and a metal plate including portions corresponding to an outer contact 14 and an electrode 15. The central contact 12 is a disk-shaped metal piece fixed at the center of a concave portion 25 of the first molded resin 20. The outer contact 14 is a substantially U-shaped metal piece fixed in the first molded resin 20 along the inner wall of the first molded resin 20 in the concave portion 25 so as to surround the central contact 12. The central contact 12 and the outer contact 14 are one example of a plurality of fixed contacts, and are brought into a state of being electrically connected or not connected by the tactile spring 60. As depicted in FIGS. 1 to 3, the central contact 12 is connected to the electrode 13 which is a rectangular metal piece protruding outward from one side surface of the push switch 1, and the outer contact 14 is connected to the electrode 15 which is a rectangular metal piece protruding outward from the opposite side surface. The push switch 1 is connected to an external device via the electrodes 13 and 15.

Figure 4:
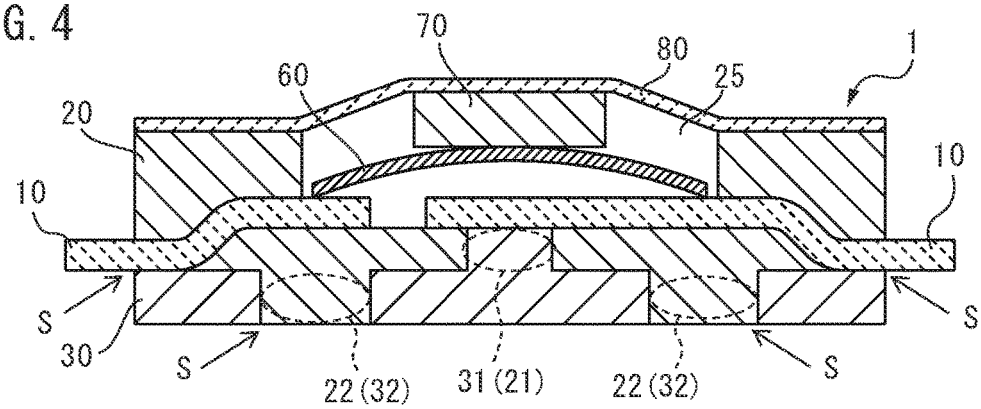
FIG. 4 is a sectional view of the push switch 1, taken along the line IV-IV.

As depicted in FIGS. 3 and 4, the first molded resin 20 has a substantially rectangular concave portion 25 in the center of which the tactile spring 60 is housed, and is molded by insert molding such that the central contact 12 and the outer contact 14 are exposed on the bottom surface of the concave portion 25. The bottom surface of the first molded resin 20 has a total of five circular through holes 21 formed by the pins of the mold at the time of insert molding at positions corresponding to the four corners and the center of the concave portion 25. Of these circular through holes 21, two through holes are depicted in FIG. 3 and one through hole, which is located in the center, is depicted in FIG. 4. Further, the first molded resin 20, on its bottom surface, has a total of four cylindrical projection portions 22 at positions corresponding to the middle of each side of the concave portion 25, defined by the shape of the mold when insert-molded. Of these cylindrical projection portions 22, one projection portion is depicted in FIG. 3 and two projection portions are depicted in FIG. 4.

The second molded resin 30 is molded so as to close the through holes 21 of the first molded resin 20 formed by the pins supporting the lead frame 10 when the first molded resin 20 is insert-molded. In other words, after the first molded resin 20 is molded, the second molded resin 30 is molded such that the through holes 21 are closed by pouring the same resin as the first molded resin 20 below the first molded resin 20. As depicted in FIG. 3, the second molded resin 30 has five cylindrical projection portions 31 projecting upward at the positions corresponding to the through holes 21 of the first molded resin 20 and closing the through holes 21. In addition, the second molded resin 30 has four circular through holes 32 into which the projection portions 22 are fit at the positions corresponding to the projection portions 22 of the first molded resin 20.

The second molded resin 30 is fit to the lower part of the first molded resin 20, thereby cooperating with the first molded resin 20 to form a case for accommodating the tactile spring 60 therein. In the push switch 1, a resin boundary S between the first molded resin 20 and the second molded resin 30 is formed on the four side surfaces and the bottom surface of the case as depicted in FIGS. 1, 2 and 4.

As depicted in FIGS. 3 and 4, the tactile spring 60 is a thin metal plate having a circular convex dome shape, and disposed on the upper portion of the first molded resin 20 (on the bottom surface of the concave portion 25) such that the end of the tactile spring 60 contacts the outer contact 14. The tactile spring 60 is an example of a movable member and deforms when an operation load is applied, which brings the central contact 12 and the of contact 14 into and out of contact with each other. In other words, when an operation load is applied and the tactile spring 60 is pressed, the tactile spring 60 is deformed so that the dome-shaped curvature collapses, and at least the central portion of the tactile spring 60 is inverted and contacts the central contact 12. As a result, the central contact 12 and the outer contact 14 are electrically connected and the switch is turned on. Further, when the operation load is removed, the dome shape of the tactile spring 60 is restored to its original state. As a result, the central contact 12 and the outer contact 14 are not electrically connected, and the switch is turned off. The tactile spring 60 may be configured such that only its central portion may be deformed into a concave shape or the whole of the tactile spring 60 may be deformed into a concave shape.

The pressing member 70 is a resin member (actuator) for pressing down the tactile spring 60. As depicted in FIG. 4, the pressing member 70 is disposed between the tactile spring 60 and the protection sheet 80 and is fixed (clamped) by them. The pressing member 70 functions to transmit the pushing force (operation load) to the tactile spring 60 when the pusher (not depicted) is pushed down.

The protection sheet 80 is a flexible insulating resin sheet, and its end portion is adhered to the upper surface edge portion of the first molded resin 20 to cover the concave portion 25. The protection sheet 80, together with the first molded resin 20 and the second molded resin 30, encloses (sealing) the tactile spring 60 and the pressing member 70 in the concave portion 25.

Since the second molded resin 30 is fit to the lower part of the first molded resin 20, the through holes 21 of the first molded resin 20 are all closed, and the bottom surface of the push switch 1 is made into a flat surface. This prevents solvent such as flux from permeating into the inside of the push switch 1 from the through holes 21 due to pin marks of insert molding during, for example, mounting by reflow soldering performed after insert molding.

Figure 5:
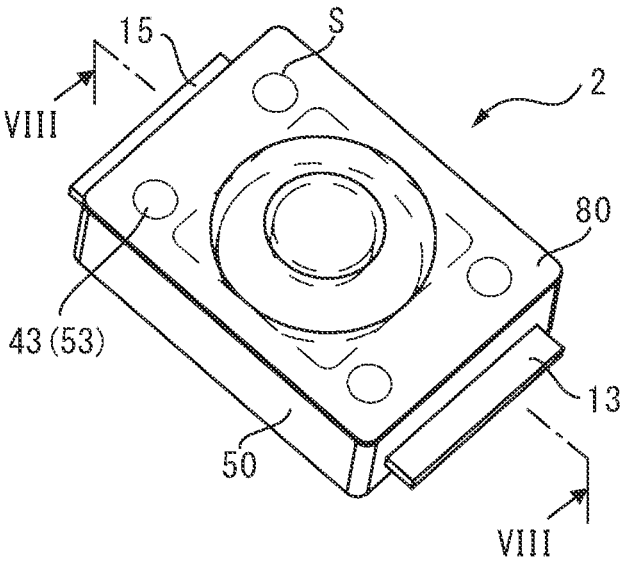
FIG. 5 is a top perspective view of a push switch 2.

FIGS. 5 to 8 are a top perspective view, an bottom perspective view, an exploded perspective view and a sectional view taken along the line VIII-VIII in FIG. 5, respectively, of a push switch 2. The push switch 2 includes a lead frame 10, a first molded resin 40, a second molded resin 50, a tactile spring 60, a pressing member 70, and a protection sheet 80, as main components. The push switch 2 differs from the push switch 1 only in the shapes of the first molded resin 40 and the second molded resin 50. Therefore, hereinafter, the first molded resin 40 and the second molded resin 50 will be mainly described with respect to the push switch 2, and repetitive description of the other constituent elements will be omitted.

As described above, in the push switch 1, the resin boundary S between the first molded resin 20 and the second molded resin 30 is formed on the four side surfaces of the case. Since the first molded resin 20 and the second molded resin 30 are made or the same resin, their adhesion is good. However, when an operation load (stress) is applied in the vertical direction during operation of the push switch cracks (peeling) may occur especially at the resin boundary S on the side surfaces of the case due to the influence of stress. Therefore, for the push switch 2, covering the side surfaces of the first molded resin 40 with the second molded resin 50 allows the resin boundary on the side surfaces of the case to be eliminated, and the resistance to stress is enhanced.

Figure 7:
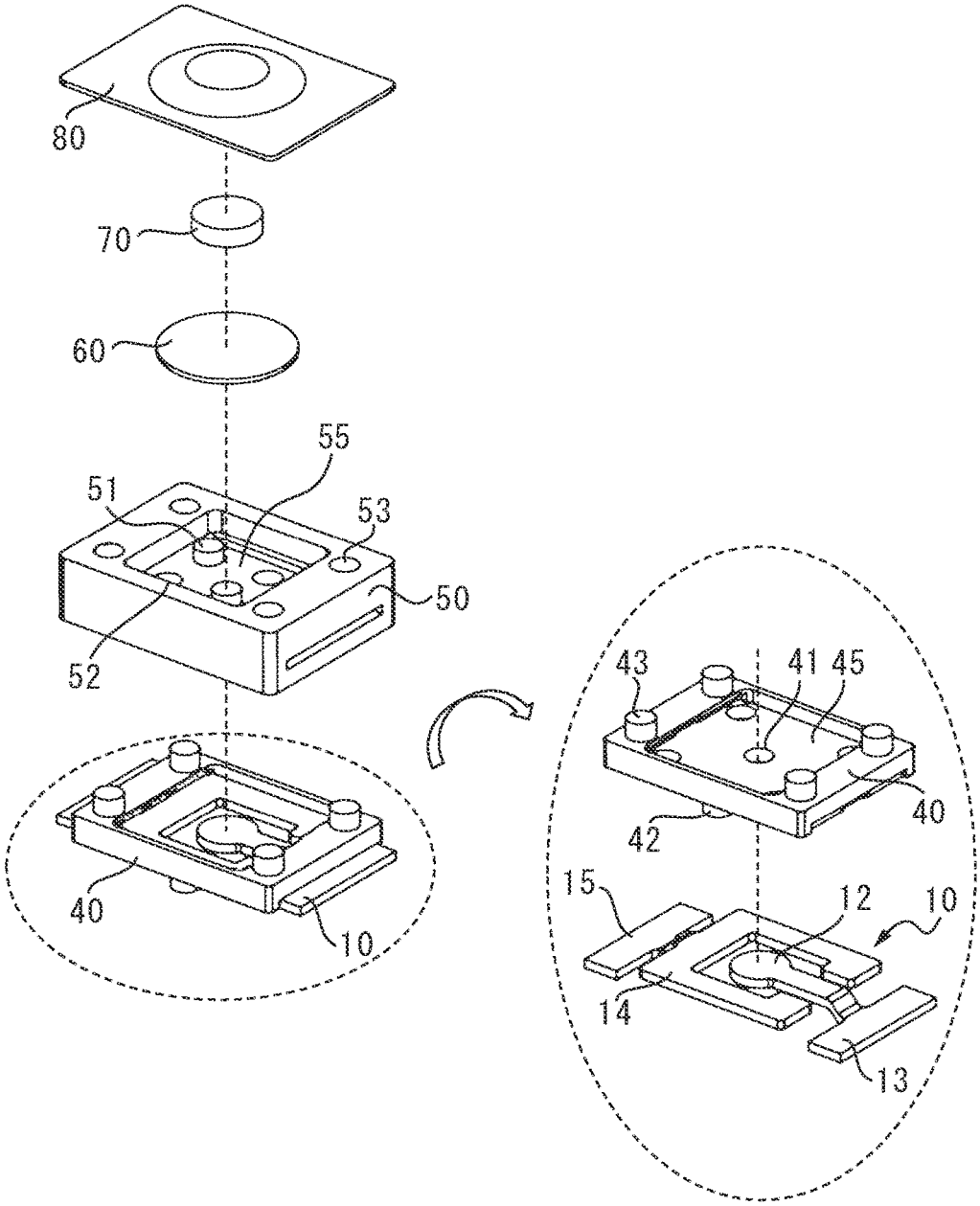
FIG. 7 is an exploded perspective view of the push switch 2.
Figure 8:
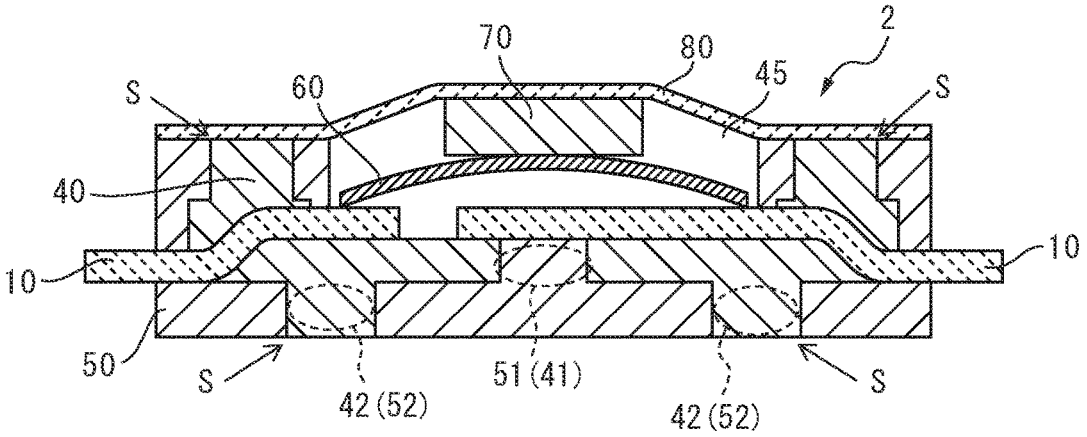
FIG. 8 is a sectional view of the push switch 2, taken along the line VIII-VIII.
Figure 9:
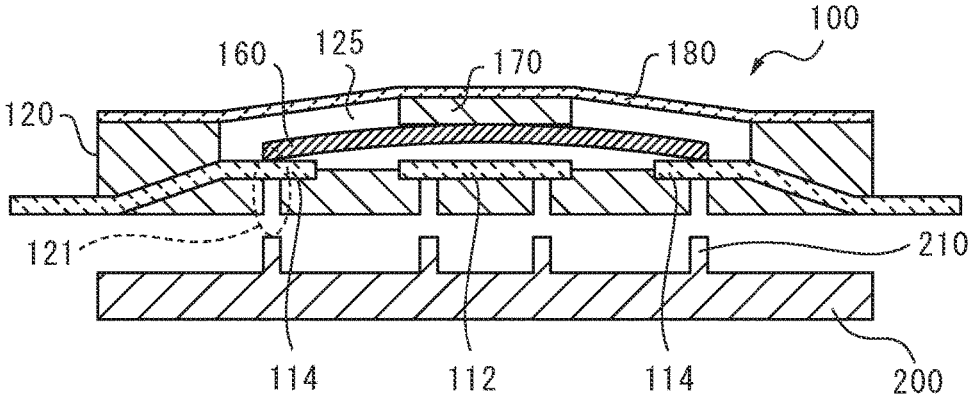
FIG. 9 is a schematic longitudinal sectional view of a push switch 100.
Figure 10:
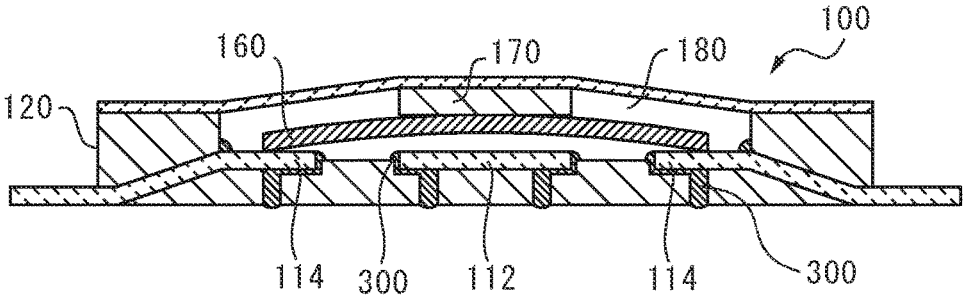
FIG. 10 illustrates permeation of solvent 300 from the through holes 121 of the case 120.

As depicted in FIGS. 7 and 8, the first molded resin 40 has a substantially rectangular concave portion 45 in the center of which the tactile spring 60 is housed, and is molded by insert molding such that the central contact 12 and the outer contact 14 are exposed on the bottom surface of the concave portion 45. The bottom surface of the first molded resin 40 has a total of five circular through holes 41 formed by the pins of the mold at the time of insert molding at positions corresponding to the four corners and the center of the concave portion 45. Of these circular through holes 41, four through holes are depicted in FIG. 7 and one through hole, which is located in the center, is depicted in FIG. 8. Further, the first molded resin 40, on its bottom surface, has a total of four cylindrical projection portions 42 at positions corresponding to the middle of each side of the concave portion 45, defined by the shape of the mold when insert-molded. Of these cylindrical projection portions 42, one projection portion is depicted in FIG. 7 and two projection portions are depicted in FIG. 8. In addition, in the push switch 2, the upper surface of the first molded resin 40 has a total of four cylindrical resin bosses 43, which are to be joined to the second molded resin 50, at the four corners on the outside of the concave portion 45.

The second molded resin 50 closes the through holes 41 of the first molded resin 40 formed by the pins supporting the lead frame 10 when the first molded resin 40 is insert-molded, and is molded so as to cover the four side surfaces of the first molded resin 40. In other words, after the first molded resin 40 is molded, the second molded resin 50 is molded such that the through holes 41 are closed and the four side walls of the push switch 2 are formed by pouring the same resin as the first molded resin 40 below and into the sides of the first molded resin 40.

As depicted in FIG. 7, the second molded resin 50 has five cylindrical projection portions 51 projecting upward at the positions corresponding to the through holes 41 of the first molded resin 40 and closing the through holes 41. In addition, the second molded resin 50 has four circular through holes 52 into which the projection portions 42 are fit at the positions corresponding to the projection portions 42 of the first molded resin 40. The projection portions 51 and the through holes 52 are formed in the concave portion 55 of the second molded resin 50 corresponding to the concave portion 45 of the first molded resin 40. Furthermore, in the push switch 2, the upper surface of the second molded resin 50 has a total of four circular through holes 53, into which the resin bosses 43 of the first molded resin 40 are fit, at the four corners on the outside of the concave portion 55. In FIG. 5, the resin bosses 43 which are fit into the through holes 53 are covered with the protection sheet 80. However, the upper surfaces of the resin bosses 43 may not be covered with the protection sheet 80.

Figure 6:
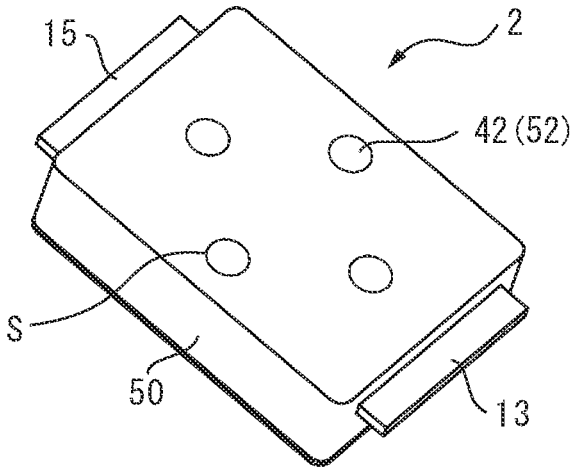
FIG. 6 is a bottom perspective view of the push switch 2.

The second molded resin 50 is molded so as to wrap the first molded resin 40, thereby cooperating with the first molded resin 40 to form a case for accommodating the tactile spring 60 therein. In the push switch 2, as depicted in FIGS. 5, 6, and 8, resin boundaries S between the first molded resin 40 and the second molded resin 50 are formed only on the upper surface and the bottom surface of the case, and no resin boundary is formed on the four side surfaces of the case.

For example, shrinkage and expansion due to heat may create delicate gaps at the resin boundary. However, in the push switch 2, since there is no resin boundary S on the side surfaces of the case, permeation of solvent or the like from the side surfaces of the case is prevented. Therefore, in the push switch 2, the flux is prevented from permeating into the case more reliability than in the push switch 1, for example, during mounting by reflow soldering. In addition, since there is no resin boundary on the side surfaces of the case of the push switch 2, the distance from the resin boundary to the lead frame 10 longer than that of the push switch 1. Therefore, even when there is permeation, it is difficult for the permeating solvent or the like to reach the lead frame 10. Furthermore, in the push switch since the second molded resin 50 is molded so as to wrap the first molded resin 40, the push switch 2 has a stronger structure against the stress in the vertical direction than the push switch 1, and occurrence of cracks at the resin boundary S is also prevented.

The movable member does not necessarily have to be a convex dome-shaped spring. The shape and arrangement of the fixed contacts may be appropriately changed according to the movable contacts, and are not limited to those described above. Further, the configuration of the above-mentioned first molded resins 20 and 40 and second molded resins 30 and 50 can be applied to a multi-stage push switch in which, for example, switching with two or more stages is available. Furthermore, this configuration can be applied to not only the push switch that is pressed in the vertical direction, but also, for example, a slide switch that operated in the lateral direction.

The invention claimed is:

1. A switch comprising:

a first molded resin molded integrally with a plurality of fixed contacts, the first molded resin including a first through hole formed under the plurality of fixed contacts and a first projection portion formed on a bottom surface of the first molded resin;

a movable member disposed above the first molded resin to bring the plurality of fixed contacts into and out of electrical contact with each other; and a second molded resin molded so as to cover at least the bottom surface of the first molded resin, the second molded resin including a second projection portion filling the first through hole and a second through hole filled with the first projection portion, the second through hole being formed in a bottom surface of the second molded resin, wherein the bottom surface of the second molded resin is a flat surface on which a resin boundary between the first molded resin and the second molded resin is formed.

2. The switch according to claim 1, wherein the second molded resin closes the first through hole from below the first molded resin and covers a side surface of the first molded resin, so that the second molded resin in cooperation with the first molded resin forms a case that houses the movable member therein.

3. The switch according to claim 2, wherein there is no boundary line between the first molded resin and the second molded resin on a side surface of the case.

4. A method of manufacturing a switch comprising:

supporting a plurality of fixed contacts with a pin from below;

molding a first molded resin integrally with the plurality of fixed contacts by insert molding so that a first through hole is formed at a position of the pin and that a portion of a bottom surface of the first molded resin projects downward;

disposing a movable member for bringing the plurality of fixed contacts into and out of electrical contact with each other above the first molded resin; and molding a second molded resin by insert molding so as to cover at least the bottom surface of the first molded resin and fill the first through hole, wherein the second molded resin is molded so that a second through hole filled with a projection portion of the first molded resin is formed in a bottom surface of the second molded resin, and thereby the bottom surface of the second molded resin becomes a flat surface on which a resin boundary between the first molded resin and the second molded resin is formed.

* * * * *